US005411778A

United States Patent [19]

Diaz et al.

[11] Patent Number: 5,411,778

[45] Date of Patent: May 2, 1995

[54] ROLLERS FOR USE IN ELECTROPHOTOGRAPHIC DEVELOPMENT

[75] Inventors: Arthur F. Diaz, San Jose, Calif.; Thomas H. Baum, New Fairfield, Conn.

[73] Assignees: International Business Machines Corp., Armonk, N.Y.; Lexmark Corp., Lexington, Ky.

[21] Appl. No.: 312,572

[22] Filed: Sep. 26, 1994

[51] Int. Cl.[6] ..... G03G 15/06

[52] U.S. Cl. ..... 428/35.7; 428/36.91; 428/922; 355/259; 355/274; 355/219; 355/271; 430/99; 430/961

[58] Field of Search ..... 428/35.7, 36.91, 422, 428/423.1, 447, 922; 355/259, 219, 271, 274; 430/99, 961

[56] References Cited

U.S. PATENT DOCUMENTS

| | | | |
|---|---|---|---|
| 4,008,260 | 2/1977 | Kunstle et al. | 266/439 R |
| 4,066,352 | 1/1978 | Kameda et al. | 355/3 TE |
| 4,404,408 | 9/1983 | Wirth et al. | 568/680 |
| 4,558,144 | 12/1985 | Fay et al. | 556/40 |
| 4,869,982 | 9/1989 | Murphy | 430/48 |
| 4,970,098 | 11/1990 | Ayala-Esquilin et al. | 42/36 |
| 5,028,508 | 7/1991 | Lane et al. | 430/115 |
| 5,240,814 | 8/1993 | Held | 430/291 |
| 5,281,506 | 1/1994 | Badesha et al. | 430/124 |
| 5,285,248 | 2/1994 | Menjo et al. | 355/284 |

OTHER PUBLICATIONS

Fedoseev Ma, Balan Vt, Surkov VD, "Polyurethane Stabilisation Process-Involves Incorporation of Metal Bis-Thenoly-Tri:fluoro-acetyl-acetonate into Polymer Compsn." Rusian SU 1321727.

*Primary Examiner*—Charles R. Nold
*Attorney, Agent, or Firm*—Robert B. Martin

[57] ABSTRACT

The present invention relates to a roller for use in electrophotographic development comprising a rigid substrate and a polymeric covering comprising metal 1,3 bis perfluoroalkyl (1,3 dioxopropane) mixed in a polymer.

9 Claims, No Drawings

ROLLERS FOR USE IN ELECTROPHOTOGRAPHIC DEVELOPMENT

FIELD OF THE INVENTION

The present invention relates to rollers for use in electrophotographic development.

BACKGROUND OF THE INVENTION

In electrophotography, an image comprising an electrostatic field pattern, usually of nonuniform strength (also retorted to as an electrostatic latent image), is formed on an insulative surface of a photoconductor drum. The insulative surface of the drum comprises a photoconductive layer and an electrically-conductive substrate. The electrostatic latent image may be formed by imagewise photo-induced dissipation of portions of an electrostatic field previously formed on the insulative surface of the drum. Typically, the electrostatic latent image on the drum is then developed into a toner image by contacting the latent image with an electrostatically-charged toner composition generally containing a pigment. The electrostatically-charged toner is generally disposed on the drum from a developer roller. In some systems, the toner image is then transferred with an intermediate transfer roller from the drum onto a transfer medium, such as paper, and fixed thereon by heating and/or pressure. The last step involves cleaning residual toner from the photoconductor drum. The rollers used in the development process are the developer roller and the transfer roller. These rollers require specific physical properties such as low dielectric constant, hardness, pliability, and long-term stability in a electrical, high-temperature, high-humidity environment. It is also desired that the rollers have an operating resistivity of about $5\times10^8$ to about $5\times10^9$ ohm-cm under operating temperature and humidity conditions.

Polymeric materials having suitable mechanical properties for use in development and transfer rollers are silicones, polysiloxane, and polyurethanes. Unfortunately, these materials each have too high of an electrical resistivity (e.g., $10^{11}$ to $10^{12}$ ohm.cm) to be suitable for use in electrophotographic development.

Kameda et al., U.S. Pat. No. 4,066,352, disclose a transfer roller for electrophotographic printing comprising a polyurethane foam covering on a rigid substrate. The polymeric covering has electroconductive powders dispersed therein to achieve the proper electrical resistivity. Kameda discloses as electroconductive powders such materials as salts, carbon black, and metal powders such as aluminum, silver, and the like. Unfortunately, the poor solubility and dispersability of the materials in the polymer results in nonuniform electrical resistivity. Further, certain dopants, such as carbon black, require high loading which negatively effects the mechanical properties of the covering. The salts are moisture sensitive and therefore cause large variations in resistivity and thus performance with changes in humidity.

Therefore, it is an object of the present invention to provide an improved roller for use in electrophotographic development. Other objects and advantages will be apparent from the following disclosure.

SUMMARY OF THE INVENTION

The present invention relates to an improved roller for use in electrophotographic development comprising a polymer and metal 1,3 bis perfluoroalkyl (1,3 dioxopropane). Suitable polymers include silicone, polysiloxane, and polyurethane. Suitably, the polymer will be disposed on a rigid substrate, suitably a cylindrically-shaped rigid substrate.

A more thorough disclosure of the present invention is presented in the detailed description which follows.

DETAILED DESCRIPTION OF THE INVENTION

The present invention relates to an improved roller for use in electrophotographic development comprising a polymer having metal 1,3 bis perfluoroalkyl (1,3 dioxopropane) mixed therein.

Rollers for use in electrophotographic development include both developer rollers used to transfer toner onto the photoconductor and intermediate transfer rollers used in some systems in transferring the toner from the photoconductor to the paper. Rollers for use in electrophotographic development are well known in the art as disclosed in Baker et al. U.S. Pat. No. 5,248,560, the disclosure of which is incorporated herein by reference.

Suitably, the roller comprises a rigid substrate, suitably cylindrically-shaped, having a polymeric covering disposed thereon. Alternatively, the roller can comprise a plurality of spaced-apart rigid cylinders (e.g., two or three) having one polymeric belt-shaped covering disposed around all of the cylinders. Suitably, the substrate is an electrically-conductive metal, such as aluminum.

It is desired that the polymer used as a covering for electrophotographic development rollers of the present invention have a uniform operating electrical resistivity (resistivity at operating temperature, e.g., about 50° C.) of about $5\times10^8$ to about $5\times10^9$ ohm.cm, preferably about $1\times10^9$ to about $5\times10^9$ ohm.cm. Preferably, the polymer will have only small variations of resistivity with changes in temperature and humidity. Suitable polymers for the roller of the present invention include silicone, urethane, and polysiloxane. Preferably, the polymer will be crosslinkable by thermal or UV curing to achieve a hardness of about 40 to 70 Shore A hardness.

The polymeric covering of the roller of the present invention has homogeneously dispersed and/or dissolved therein metal 1,3 his perfluoroalkyl (1,3 dioxopropane), which is also known as metal bis (beta dionate). Suitable metal 1,3 bis perfluoroalkyl (1,3 dioxopropane) have the formula M $[RCOCH_2COR_1]$ where M is a metal selected from Co, Cu, Li, K, Cs, Fe, Al, and Ag, and $R_1$ and R are independently $C_{1-6}$ perfluoroalkyl, preferably $C_{1-4}$ perfluorolower alkyl, more preferably trifluoromethyl or pentafluoroethyl. The preferred compound is metal 1,1,1,5,5,5,-hexafluoro-2,4-pentane dione.

Other transition metals (e.g., 3d transition and alkali metals) can also be utilized in the dionates and rollers having a polymeric covering with such dionates are contemplated as equivalent to those claimed herein.

The polymeric covering will generally comprise about 0.1 to 10 weight % of the dioxopropane and about 90 to 99.9 weight % of the polymer. Preferably, the polymeric covering will comprise about 1 to 5 weight % of the dioxopropane and the remainder polymer.

The dioxopropane can be dispersed or dissolved directly in the polymer by art-known mixing methods or by dissolving the dioxopropane in a minimal amount of a suitable solvent, such as tetrahydrofuran, and mixing the solution into the polymer. The dioxopropanes of the present invention exhibit enhanced solubility in the solvents and polymer to enable higher loading.

The roller can be formed by art-known procedures such as by coating the outside of a cylindrically-shaped rigid substrate with the polymer composition and then heating the composition to an elevated temperature (e.g., about 100°–120° C.) to remove the solvent and crosslink the polymer.

The following examples are detailed descriptions of the process of the present invention. The detailed preparations fall within the scope of, and serve to exemplify, the more generally described methods set forth above. The examples are presented for illustrative purposes only, and are not intended as a restriction on the scope of the invention.

EXAMPLE 1

Copper 1,3 bi trifluoromethyl (1,3 dioxopropane)(-copper II 1,1,1,5,5,5-hexafluoro-2,4-pentanedionate) Cu $(hfac)_2$ was dissolved in a minimal amount of tetrahydrofuran. Polysiloxane was added to the mixture to produce a composition of 5% dioxopropane by weight and 95 weight % polysiloxane.

The solution was mixed and cast onto gold-coated glass slides. The gold layer serves as the bottom electrode for subsequent impedance measurements. The film was then thermally cured at 120° C. on a hot plate for 15–20 minutes. The cured film was top coated with a conductive silver paint and analyzed by impedance spectroscopy as a function of the frequency. The measured phase angle was used to calculate the RC time constant, and the measured impedance was used to calculate the film resistivity and dielectric constant. The film had a room temperature resistivity of $10^9$ ohm.cm, a hardness of 25 Shore A, and a dielectric constant of 4.5.

EXAMPLE 2

Following the procedure of Example 1, a film of 5 weight % Cu $(hfac)_2$ in polyurethane was formulated and cured. It had a resistivity of $8\times10^8$ and a dielectric constant of 50. The hardness was measured to be about 40 Shore A.

EXAMPLE 3

Following the procedure of Example 1, a film comprising 5 weight % of cobalt II $(fhac)_2$ in silicone elastomer was prepared and cured to give a resistivity of $8\times10^9$ and a film hardness of about 25 Shore A.

Although this invention has been described with respect to specific embodiments, the details thereof are not to be construed as limitations for it will be apparent that various embodiments, changes, and modifications may be resorted to without departing from the spirit and scope thereof, and it is understood that such equivalent embodiments are intended to be included within the scope of this invention.

What is claimed is:

1. A roller for use in electrophotographic development comprising a rigid substrate and a polymeric covering, the covering comprising polymer and metal 1,3 bis perofluoralkyl (1,3 dioxopropane).

2. The roller of claim 1 wherein the metal is selected from cobalt, iron, copper, aluminum, or silver.

3. The roller of claim 2 wherein the polymer is selected from polyurethane, polysiloxane, or silicone.

4. The roller of claim 3 wherein the dioxopropane is metal 1,3 bis $C_{1-4}$ perfluoroalkyl (1,3 dioxopropane).

5. The roller of claim 4 wherein the dioxopropane is metal 1,3 bis trifluoromethyl (1,3 dioxopropane).

6. The roller of claim 5 wherein the metal is selected from cobalt, copper, or iron.

7. The roller of claim 6 wherein the polymer is silicone.

8. The roller of claim 4 wherein the covering is disposed on a cylindrically-shaped rigid substrate.

9. The roller of claim 4 wherein the covering is disposed around a plurality of cylindrically-shaped rigid substrates.

* * * * *